United States Patent [19]

Gower

[11] Patent Number: 4,637,314

[45] Date of Patent: Jan. 20, 1987

[54] RAILROAD SPIKE RESINSTALLATION APPARATUS

[76] Inventor: David I. Gower, P.O. Box 6266, Reno, Nev. 89513

[21] Appl. No.: 746,755

[22] Filed: Jun. 20, 1985

[51] Int. Cl.[4] ..... E01B 29/26

[52] U.S. Cl. ..... 104/17.1; 104/307

[58] Field of Search ..... 104/1 R, 1 A, 12, 17 R, 104/17 A, 2; 305/8, 15, 23; 180/9.26, 9.28, 9.3

[56] References Cited

U.S. PATENT DOCUMENTS

| | | | |
|---|---|---|---|
| 421,908 | 2/1890 | Close . | |
| 434,529 | 8/1890 | Sorenson . | |
| 1,268,736 | 6/1918 | Lightell . | |
| 1,548,664 | 8/1925 | Davis | 305/8 |
| 1,558,943 | 10/1925 | Swanson . | |
| 1,846,095 | 2/1932 | Elmer . | |
| 2,105,042 | 1/1938 | Kegresse | 180/9.28 |
| 2,799,230 | 7/1957 | Jensch . | |
| 3,010,407 | 11/1961 | Godfrey et al. . | |
| 3,098,453 | 7/1963 | Fee . | |
| 3,628,461 | 12/1971 | Plasser et al. . | |
| 3,717,100 | 2/1973 | Sieke et al. | 104/12 |
| 3,795,198 | 3/1974 | Plasser et al. | 104/12 |
| 4,178,236 | 12/1979 | Theurer . | |
| 4,294,046 | 10/1981 | Damiano . | |
| 4,478,152 | 10/1984 | Holley . | |
| 4,522,127 | 6/1985 | Miller et al. | 104/1 R |

FOREIGN PATENT DOCUMENTS

| | | | |
|---|---|---|---|
| 302434 | 6/1971 | U.S.S.R. | 104/17 A |

*Primary Examiner*—Robert B. Reeves
*Assistant Examiner*—Dennis C. Rodgers
*Attorney, Agent, or Firm*—Laney, Dougherty, Hessin & Beavers

[57] ABSTRACT

A portable apparatus for reinstalling loosened railroad spikes. The apparatus includes a wheel-mounted chassis adapted for rolling along railroad rails and having a crawler attached thereto having a lowered, operating position and a raised position. The crawler includes a carriage with a plurality of crawler wheels thereon interconnected by a plurality of link-belts. The belts engage loosened spikes as the apparatus rolls along the rails when said carriage is in the operating position. The link-belts have a plurality of spike head engaging indentations defined along an outer surface thereof. In the preferred embodiment, at least one of said link-belts further engages a crawler drive wheel portion of a drive wheel mounted on the chassis. The drive wheel may be rotated by a hydraulic motor. The carriage may be alternately raised and lowered by a hydraulic cylinder actuated by fluid pumped thereinto from a pump through a two-way hydraulic fluid valve.

25 Claims, 5 Drawing Figures

RAILROAD SPIKE RESINSTALLATION APPARATUS

BACKGROUND OF THE INVENTION

1. Field of the Invention

This invention relates to apparatus for reinstalling loosened railroad spikes along a railroad track, and more particularly, to an apparatus having a continuous link-belt crawler for engaging loosened spikes and pressing them back to an installed position.

2. Description of the Prior Art

Installation apparatus for railroad spikes relate primarily to wheel-mounted devices which roll along the track and have vertically acting hammers which drive spikes in position. A typical device of this sort is shown in U.S. Pat. No. 1,268,736 to Lightell. Apparatus of the same general description are shown in U.S. Pat. No. 2,799,230 to Jensch and U.S. Pat. No. 3,010,407 to Godfrey et al. These devices impact the head of the spike, and such impacting must be carried out on each spike individually. This results in wear on the head of the spike and shock-loading on the spike which may result in premature cracking and failure. While such impacting is usually necessary in the initial installation of railroad spikes, it is not necessarily required for reinstalling spikes which have become loosened over a period of time.

The present apparatus utilizes a continuous link-belt track-type crawler which engages the heads of loosened spikes and forces them back into their installed position by the weight of the apparatus. This is done relatively quickly since the apparatus does not have to stop for each individual spike. There is no impacting or shock-loading on the spikes during this operation. Thus, a longer life for the spikes is expected.

SUMMARY OF THE INVENTION

The railroad spike reinstallation apparatus of the present invention comprises a wheel-mounted chassis adapted for rolling along the rails of a railroad track and includes a track-type crawler attached to the chassis. The crawler is adapted for rolling adjacent the road bed and a lower portion of the rail for contacting upwardly extending spikes which have become loosened and forcing the spikes downwardly back to an installed position by partial weight of the apparatus. The apparatus further comprises lifting means for raising the crawler above the spikes so that the crawler does not engage the spikes unless desired.

In the preferred embodiment, the crawler includes a carriage having a plurality of crawler wheels rotatably attached thereto. Tandem pairs of crawler wheels are interconnected by continuous link-belts. The outer surface of each link-belt defines a plurality of indentations therein, each indentation being dimensioned to conform to the head of a railroad spike. As the apparatus rolls along the track, the railroad spikes are engaged in at least some of the indentations, thus preventing slippage.

In the preferred embodiment, at least one of the wheels on which the chassis is mounted has a crawler drive wheel attached thereto or forming a portion thereof. The crawler drive wheel is interconnected with at least one tandem pair of crawler wheels attached to the carriage by the corresponding continuous link-belt. Drive means, such as a hydraulic motor, powers the drive wheel on the chassis, and the crawler drive wheel portion is thus concurrently driven.

With the lifting means, the crawler can be raised from its lowered, operating position to the raised position above the spikes. Preferably, the lifting means includes a hydraulic cylinder attached to the carriage and chassis and is actuated by fluid transmitted by a hydraulic pump through a two-way valve. In one position of the valve, the hydraulic fluid will force the hydraulic cylinder to move the carriage and crawler downwardly, and in the opposite position, the carriage and crawler may be raised.

Preferably, a crawler is positioned on both inner and outer sides of each of the two rails forming the track.

An important object of the invention is to provide a portable apparatus for reinstalling loosened railroad spikes without significant impacting on the heads thereof.

Another object of the invention is to provide a weighted apparatus having a crawler for engaging loosened railroad spikes and downwardly forcing them back into an installed position by partial weight of the apparatus.

A further object of the invention is to provide a crawler for engaging railroad spikes, said crawler being alternately movable from a raised to a lowered position.

Still another object of the invention is to provide a crawler for traveling alongside a railroad track, said crawler having a plurality of indentations in the outer surface thereof for nonslipping engagement of railroad spikes so that the spikes may be reinstalled in a clamping position against the rail.

Additional objects and advantages of the invention will become apparent as the following detailed description of the preferred embodiment is read in conjunction with the accompanying drawings which illustrate such preferred embodiment.

DETAILED DESCRIPTION OF THE PREFERRED EMBODIMENT

Figure 1:
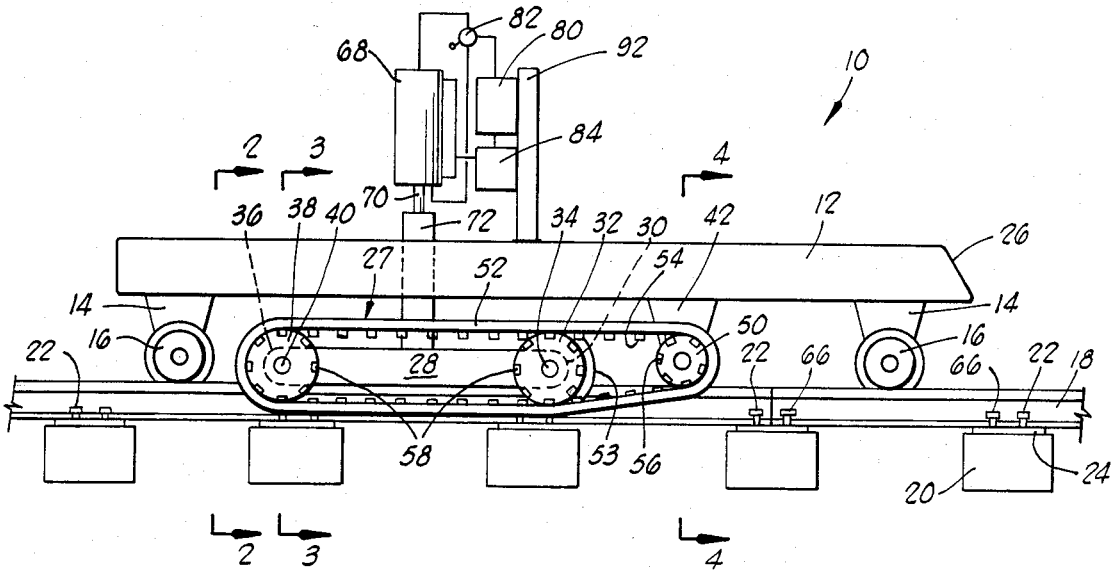
FIG. 1 is a side elevation of the railroad spike reinstallation apparatus of the present invention.

Referring now to the drawings, and particularly to FIG. 1, the railroad spike reinstallation apparatus of the present invention is shown and generally designated by the numeral 10. The apparatus includes a chassis 12 having a plurality of downwardly extending wheel struts 14 on opposite sides of the chassis, each wheel strut having a wheel 16 rotatably attached thereto for engaging and rolling along a rail 18 of a railroad track. Rail 18 is conventionally mounted to a plurality of ties 20 by spikes 22. A rail plate 24 is normally positioned between each rail 18 and each tie 20, and the spikes extend through holes in the plates. Apparatus 10 has a forwardly directed end 26.

Referring now also to FIGS. 2–5, a crawler 27 is positioned below chassis 12. Crawler 27 includes a carriage 28 having a forward portion 30 to which a plurality of crawler or carriage wheels 32 are mounted by means of a shaft 34. Similarly attached to a rear portion 36 of carriage 28 are a plurality of crawler or carriage wheels 38 mounted on a shaft 40. Preferably, wheels 32 and 38 are substantially identical, and one of each such wheels is tandemly mounted on each side of each rail 18. Thus, in the preferred embodiment, but not by way of limitation, there are a total of four sets of crawler front and rear wheels. In other words, there is a tandem pair of crawler wheels on each side of each rail.

Figure 5:
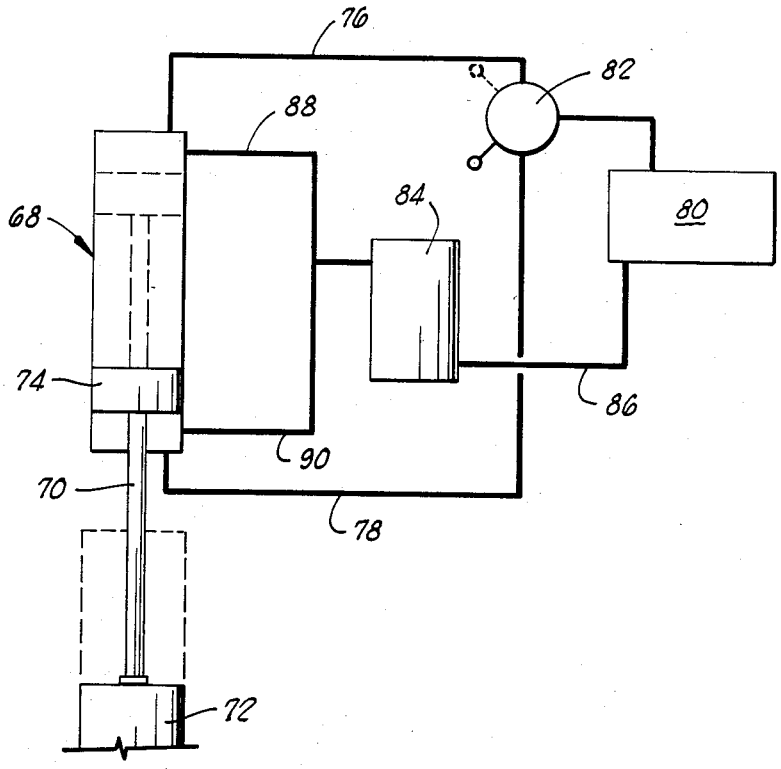
FIG. 5 is a schematic of the lifting means for raising and lowering a crawler on the apparatus.

As shown in FIGS. 1 and 5, a pair of wheel struts 42 extend downwardly from chassis 12 in a manner similar to wheel struts 14. Rotatably attached to each wheel strut 42 is a drive wheel 44 mounted on a drive shaft 46. Drive wheel 44 is adapted to rollably engage rail 18. Preferably, a drive means, such as a hydraulic motor 48 is used to power drive shaft 46, and thus drive wheel 44, for propelling apparatus 10 along the track. However, in another embodiment, chassis 12 could simply be pulled along behind some other powered apparatus.

Figure 4:
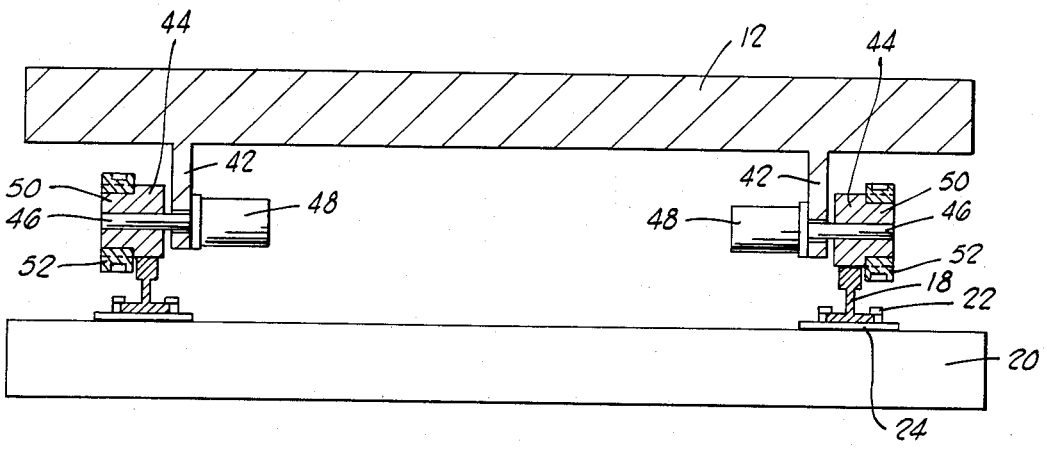
FIG. 4 is a cross-sectional view of the apparatus taken along lines 4—4 in FIG. 1.

Forming a part of at least one drive wheel 44 is crawler drive wheel portion 50. Although an integral drive wheel 44 with crawler drive wheel portion 50 is preferred, it will be clear to those skilled in the art that the crawler drive wheel portion could also be a separate wheel mounted on drive shaft 46 with drive wheel 44. Crawler drive wheel portion 50 is in tandem relationship to a crawler front wheel 32 and a crawler rear wheel 38 and is interconnected to the crawler wheels by a continuous, link-belt 52. As shown in FIG. 4, there are two crawler drive wheel portions 50 positioned on the outer side of each rail 18. The pairs of crawler front wheels 32 and crawler rear wheels 38 positioned on the inner sides of rails 18 are interconnected by a similar, but obviously shorter, link-belt 53. Belts 52 and 53 have a plurality of lugs 54 protruding from inner surfaces thereof. Lugs 54 engage grooves 56 in crawler drive wheel portion 50 and corresponding grooves 58 in crawler wheels 32 and 38. Thus, as crawler drive wheel portion 50 is rotated, corresponding tandem crawler wheels 32 and 38 will also be rotated along with belt 52. The other crawler wheels and interconnecting belts will also roll along as apparatus 10 is moved.

Figure 2:
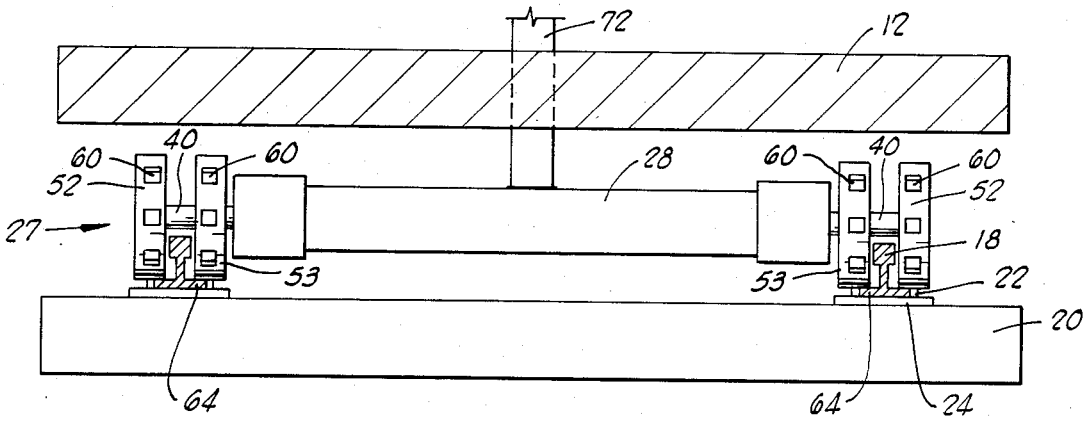
FIG. 2 is a section view of the apparatus taken along lines 2—2 in FIG. 1.
Figure 3:
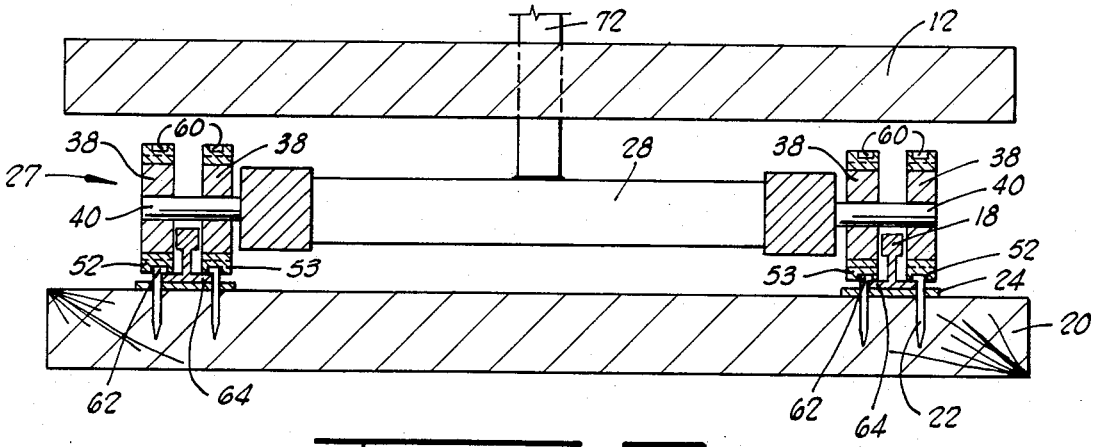
FIG. 3 is a cross section taken along lines 3—3 in FIG. 1.

Disposed along the outer surface of each belt 52 and 53 are a plurality of indentations 60, dimensioned to conform to heads 62 of spikes 22, as shown the most clearly in FIGS. 2 and 3. Thus, belts 52 and 53, and more particularly indentations 60 engage heads 62 of loosened spikes, indicated by numeral 66 in FIG. 1, so that as crawler 27 rolls along the road bed, the loosened spikes are forced downwardly to their reinstalled position to clamp against clamps 64 of rail 18. Indentations 60 prevent slippage.

Carriage 28 may be raised and lowered with respect to chassis 12 such that crawler 27 defines a lowered, operating position, as shown in FIGS. 1–3, in which belts 52 and 53 roll along lower, outwardly extending flanges 64 of rail 18, and further defines a raised position in which belts 52 and 53 do not engage spikes 22 or rail flanges 64. In the preferred embodiment, but not by way of limitation, this is accomplished by means of a substantially vertically oriented hydraulic cylinder 68 having a piston rod 70 connected to positioning plunger 72 attached to carriage 28. Hydraulic cylinder 68 is of a conventional, reciprocating type having a piston 74 disposed therein and actuated by hydraulic fluid transmitted thereto through lines 76 or 78 by means of a hydraulic pump 80. Pump 80 discharges fluid into two-way valve 82 for delivering fluid through line 76 to the top of piston 74 for lowering the piston and thus crawler 27, and alternately, delivering fluid through line 78 below piston 74 for raising the piston and the crawler. Two-way valve 82 is shown as a manually operated valve, but could be of a remotely operated type as well. Fluid is provided to pump 80 from reservoir 84 through line 86. Fluid discharged from hydraulic cylinder 68 reaches reservoir 84 through lines 88 or 90. This hydraulically actuated lifting means may be mounted on chassis 12 by a bracket 92 or similar device.

It can be seen, therefore, that the railroad spike reinstallation apparatus of the present invention is well adapted to carry out the objects and attain the ends and advantages mentioned, as well as those inherent therein. While a presently preferred embodiment of the invention has been described for the purposes of this disclosure, numerous changes in the construction and arrangement of parts may be made by those skilled in the art. All such changes are encompassed within the scope and spirit of this invention as defined by the appended claims.

What is claimed is:

1. An apparatus for reinstalling without impacting loosened spikes spaced along a railroad rail for clamping said rail in a position adjacent a road bed, said apparatus comprising:

a wheel-mounted chassis adapted for rolling on said rail; and a crawler connected to said chassis and adapted for rolling adjacent a lower portion of said rail when in an operating position, said crawler rollingly contacting said loosened spikes such that weight is applied to said spikes directly by said crawler for downwardly forcing said spikes back to an installed position as said crawler continuously rolls along said road bed.

2. The apparatus of claim 1 further comprising lifting means for moving said crawler to a raised position spaced above said spikes.

3. The apparatus of claim 2 wherein said lifting means is characterized as a hydraulic cylinder connected to said crawler and chassis, said cylinder being actuatable for alternately moving said crawler between said operating position and said raised position.

4. The apparatus of claim 1 further comprising:

a drive wheel engaged with said rail and rotatably mounted on said chassis and connected to said crawler; and driving means for rotating said drive wheel for propelling said chassis along said rail and for concurrently rolling said crawler.

5. The apparatus of claim 4 wherein said driving means is characterized as a hydraulic motor.

6. The apparatus of claim 1 wherein said crawler defines a plurality of identations along an outer surface thereof for engaging heads of said spikes as said crawler reinstalls said spikes while continuously rolling adjacent said rail lower portion.

7. An apparatus for reinstalling without impacting loosened railroad spikes used to clamp a lower flange of a rail to a road bed, said apparatus comprising:

a chassis mounted on a plurality of chassis wheels, said chassis wheels being positionable on said rail for rolling engagement therewith;

a carriage attached to said chassis;

a plurality of carriage wheels positionable adjacent said rail and rotatably attached to said carriage; and a link-belt interconnecting said carriage wheels, an outer surface of said belt being rollingly engageable with said loosened spikes adjacent said rail lower flange, whereby a weight is directly applied to said spikes through said carriage wheels and link-belt for forcing said spikes to a reinstalled position holding said rail as said chassis is continously rolled along said rail.

8. The apparatus of claim 7 further comprising lifting means for raising and lowering said carriage with respect to said chassis.

9. The apparatus of claim 8 wherein said lifting means is characterized by a substantially vertically oriented hydraulic cylinder connected to said carriage and mounted on said chassis, such that as said hydraulic cylinder is actuated, said carriage may be alternately raised from said position adjacent said rail lower flange to a position in which said link-belt is spaced above said spikes.

10. The apparatus of claim 7 wherein said link-belt defines a plurality of indentations along said outer surface thereof, said identations dimensionally conforming to heads of said spikes and engaging said spike heads as said link-belt rolls along adjacent said rail.

11. An apparatus for reinstalling loosened spikes used for holding railroad rails in position against a road bed, each spike having a head portion thereof, said apparatus comprising:

a chassis;

a plurality of track wheels rotatably attached to said chassis for rolling along said rail; and a crawler comprising:

a carriage attached to said chassis and having a lowered, operating position and a raised position;

a plurality of crawler wheels rotatably attached to said carriage;

a crawler drive wheel rotatably attached to said chassis; and a continuous belt interconnecting said crawler wheels and said crawler drive wheel, whereby, as said track wheels are rolled along said track without stopping, said belt is concurrently rolled along said road bed for engaging said loosened spikes and applying weight thereto for downwardly moving said spikes to a reinstalled position.

12. The apparatus of claim 11 further comprising driving means for driving said crawler drive wheel.

13. The apparatus of claim 12 wherein said driving means is characterized as a hydraulic motor.

14. The apparatus of claim 11 further comprising:

a positioning plunger attached to said carriage;

a hydraulic cylinder mounted on said chassis and having a piston rod portion connected to said plunger; and fluid actuation means for actuating said cylinder so that said positioning plunger and carriage attached thereto are raised from said operating position to said raised position, and alternately lowering said positioning plunger and carriage.

15. The apparatus of claim 14 wherein said fluid actuation means comprises:

a two-way hydraulic fluid valve in communication with said hydraulic cylinder; and a hydraulic pump for distributing hydraulic fluid through said two-way valve to said cylinder for actuation thereof.

16. A portable apparatus for reinstalling railroad spikes which have become loosened from an installed position in which rails are clamped to a road bed, said apparatus comprising:

a chassis;

a plurality of tandemly disposed wheels rotatably attached adjacent opposite sides of said chassis, said wheels being in rolling engagement with corresponding rails;

a crawler comprising:

a carriage attached to said chassis, said carriage having a lowered, operating position and a raised position with respect to said road bed, said carriage having a forward end and a rear end;

a set of forward crawler wheels rotatably attached to said carriage at said forward end thereof, such that a forward carriage wheel is positioned on inner and outer sides of each rail;

a set of rear crawler wheels rotatably attached to said carriage at said rear end thereof, such that a rear crawler wheel is tandemly disposed with respect to a corresponding front crawler wheel; and a plurality of longitudinally disposed link-belts, each link-belt interconnecting a forward carriage wheel and the corrresponding tandemly disposed rear carriage wheel and being adjacent said road bed alongside a rail for substantially continuous rolling, weighted engagement with heads of said loosened spikes when said carriage is in said operating position for weightingly downwardly moving said spikes for reinstallation thereof as said chassis rolls along said rails without stopping, said link-belts being further spaced from said road bed for substantial clearance from said spikes and road bed when said carriage is in said raised position; and lifting means attached to said chassis and said carriage for raising said carriage, and said crawler wheels and corresponding link-belts attached to said carriage, from said operating position to said raised position, and alternately lowering said carriage to said operating position.

17. The apparatus of claim 16 further comprising:

at least one drive wheel rotatably attached to said chassis and rollably engaged with one of said rails, said drive wheel having a crawler drive wheel portion tandemly disposed with respect to a crawler front wheel and the corresponding crawler rear wheel;

wherein one of said link-belts is further interconnected with said crawler drive wheel portion.

18. The apparatus of claim 16 wherein said link-belts define a plurality of indentations along an outer surface thereof, each of said indentations dimensionally conforming to a head of a spike for non-slipping engagement therewith.

19. The apparatus of claim 16 wherein said lifting means comprises:

a two-way hydraulic fluid valve having an inlet and two outlets;

a hydraulic pump in communication with said valve inlet; and a substantially vertically oriented hydraulic cylinder in communication with said valve outlets and connected to said carriage and chassis for alternately raising and lowering said chassis when correspondingly actuated by fluid pumped thereinto through said two-way hydraulic fluid valve from said hydraulic pump.

20. An apparatus for reinstalling loosened railroad spikes used to clamp a lower flange of a rail to a road bed, said apparatus comprising:

a chassis mounted on a plurality of chassis wheels, said chassis wheels being positionable on said rail for rolling engagement therewith;

a carriage attached to said chassis;

a plurality of carriage wheels positionable adjacent said rail and rotatably attached to said carriage;

a drive wheel rotatably attached to said chassis; and a link-belt interconnecting said carriage wheels, an outer surface of said belt being rollingly engageable with said loosened spikes adjacent said rail lower flange, whereby a weight is applied to said spikes for forcing said spikes to a reinstalled position holding said rail as said chassis is continuously rolled along said rail;

said link-belt being further connected to said drive wheel such that as said chassis is rolled along said track, said link-belt and carriage wheels are concurrently rolled adjacent said rail.

21. The apparatus of claim 20 further comprising driving means for rotating said drive wheel.

22. The apparatus of claim 21 wherein said driving means is characterized as a hydraulic motor.

23. The apparatus of claim 20 further comprising lifting means for raising and lowering said carriage with respect to said chassis.

24. The apparatus of claim 23 wherein said lifting means is characterized by a substantially vertically oriented hydraulic cylinder connected to said carriage and mounted on said chassis, such that as said hydraulic cylinder is actuated, said carriage may be alternately raised from said position adjacent said rail or a flange to a position in which said link-belt is spaced above said spikes.

25. The apparatus of claim 20 wherein said link-belt defines a plurality of indentations along said outer surface thereof, said indentations dimensionally conforming to heads of said spikes and engaging said spike heads as said link belt rolls along adjacent said rail.

* * * * *